US006960394B2

(12) United States Patent
Graham et al.

(10) Patent No.: US 6,960,394 B2
(45) Date of Patent: Nov. 1, 2005

(54) FABRIC REINFORCED CEMENT

(75) Inventors: Samuel E. Graham, LaGrange, GA (US); Joseph R. Royer, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 5 days.

(21) Appl. No.: 10/786,272

(22) Filed: Feb. 25, 2004

(65) Prior Publication Data

US 2005/0186409 A1 Aug. 25, 2005

(51) Int. Cl.[7] ..... B32B 7/00

(52) U.S. Cl. ..... 428/542.8; 428/110; 428/111; 428/301.4; 428/105; 428/113

(58) Field of Search ..... 428/110, 111, 298.1, 428/301.4, 542.8, 105, 113

(56) References Cited

U.S. PATENT DOCUMENTS

| | | | | |
|---|---|---|---|---|
| 4,306,911 | A * | 12/1981 | Gordon et al. | 106/644 |
| 5,549,863 | A * | 8/1996 | Symons | 264/257 |
| 5,766,724 | A * | 6/1998 | Tailor et al. | 428/110 |
| 6,156,842 | A * | 12/2000 | Hoenig et al. | 525/171 |
| 6,586,606 | B2 * | 7/2003 | Gerster et al. | 549/302 |
| 6,759,124 | B2 * | 7/2004 | Royer et al. | 428/372 |

* cited by examiner

*Primary Examiner*—Merrick Dixon
(74) *Attorney, Agent, or Firm*—Terry T. Moyer; Charlotte C. Wilson

(57) ABSTRACT

A cement panel that is reinforced with a fabric made of nucleated polypropylene fibers. The cement panel includes a core layer that is made of a lightweight cement composition. This core layer is covered with a layer of reinforcing nucleated polypropylene fabric on the top and on the bottom, each bonded to the core with a coating of cementitious material on the top and on the bottom of the core layer. On the edges of the cement panels, the fabric layers may be overlapped so as to augment the strength of these edges.

31 Claims, 2 Drawing Sheets

FABRIC REINFORCED CEMENT

BACKGROUND OF THE INVENTION

The present invention relates generally to reinforced cementitious panels or boards, and, in particular, cementitious panels or boards that are reinforced with a fabric that is unaffected by alkali attack.

The use of reinforced cement panels is well known in such industries as the ceramic tile industry. Generally, cement panels or boards contain a core formed of a cementitious material that is interposed between two layers of facing material. The facing materials employed typically share the features of high strength, high modulus of elasticity, and light weight so as to contribute flexural and impact strength to the high compressive strength but brittle material forming the cementitious core. Typically, the facing material employed with cement panels is fiberglass. Fiberglass performs particularly well in this application. Fiberglass provides greater physical and mechanical properties to the cement board. Fiberglass is also an efficient material to reinforce the cement panels because of its relatively low cost when compared with other high modulus materials.

Fiberglass, however, has a major disadvantage, which is its lack of resistance to chemical attack from the ingredients of the cements. Common cements, such as Portland cement, provide an alkaline environment when in contact with water, and the fiberglass yarn that is used in reinforcement fabrics is degraded in these highly alkaline conditions. To overcome this problem, protective polymeric coatings, such as PVC (polyvinyl chloride) plastisol coatings, are applied to the fiberglass. Although these coatings minimize fiberglass degradation, the protective coating on the fiberglass yarns is very critical to the success of the concrete panel. Even with a PVC coating, any imperfections in the coating allow sites for alkali attacks, which is accelerated with heat during the curing phase of the cementitious boards. Therefore, excess fiberglass must be included to ensure a minimum amount of strength over the life of the cement boards.

Accordingly, there remains a need for an improved cement panel that is reinforced by a fabric that both minimizes or eliminates the need to include a protective fabric coating and that retains the beneficial features of other facing materials.

SUMMARY OF THE INVENTION

According to its major aspects and briefly recited, the present invention is a new and improved cement panel that is reinforced with a fabric made of nucleated polypropylene monofilaments of high modulus. The cement panel includes a core layer that is made of a cement composition. This core layer is covered with a layer of reinforcing nucleated polypropylene monofilament fabric on the top and on the bottom, each bonded to the core with a coating of cementitious material on the top and on the bottom of the core layer. On the border edge regions of the cement panels, the fabric layers may be overlapped so as to augment the strength of these regions.

In a first embodiment, the reinforcement fabric is a bi-directional, fabric substrate including a plurality of lateral weft yarns that intersect a plurality of warp yarns at right angles. Optionally, the warp yarns and weft yarns may be bonded at the intersections by an adhesive composition. In a second embodiment, the reinforcement fabric is a tri-directional, also commonly referred to as triaxial, scrim fabric that is optionally held together by an adhesive composition. In a triaxial scrim, plural weft yarns having both an upward diagonal slope and a downward diagonal slope are located between plural longitudinal warp yarns that are located on top of the weft yarns and below the weft yarns. As used herein, the term "scrim" shall mean a fabric having an open construction used as a base fabric or a reinforcing fabric, and is generally manufactured as a laid scrim, a woven scrim, or a weft-inserted warp knit scrim.

A feature of the present invention is the use of reinforcement fabric made of nucleated polypropylene fibers in combination with the cement panels. Not only does the use of nucleated polypropylene fibers minimize or altogether eliminate the need for a protective fabric coating, but also nucleated polypropylene possesses the same if not more beneficial features of other facing materials, such as fiberglass. Further, nucleated polypropylene breaks at higher elongations than fiberglass. Because the modulus of elasticity of nucleated polypropylene is similar to that of cement, the cement board or panel is less likely to fail for being too brittle, or too flexible. Polypropylene is also more resistant to alkali attack than fiberglass. Accordingly, the degradation of the reinforcement fabric due to alkali attack is reduced and the strength of the cement panel throughout its use is increased. Therefore, less nucleated polypropylene fiber needs to be employed in the reinforcement of the panels.

In addition, the nucleated polypropylene provides lower shrinkage yarns in comparison to non-nucleated polypropylene, which allows the yarns to maintain their high modulus characteristic better at elevated temperatures, such as those experienced during certain cement curing processes.

Other features and advantages of the present invention will be apparent to those skilled in the art from a careful reading of the Detailed Description of the Preferred Embodiments presented below and accompanied by the drawings.

DETAILED DESCRIPTION OF THE PREFERRED EMBODIMENTS

Figure 1:
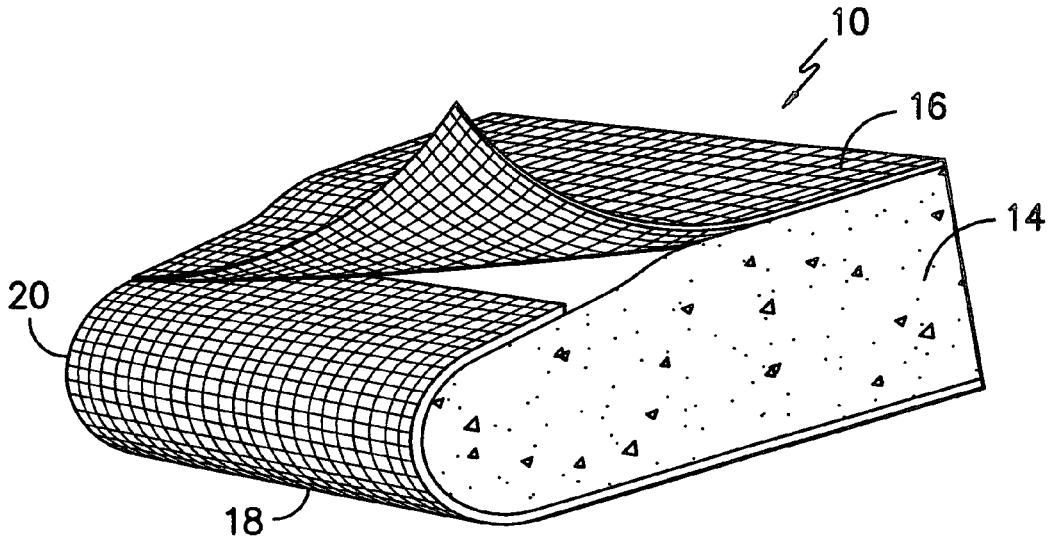
FIG. 1 is a perspective view of a reinforced cement panel according to a preferred embodiment of the present invention.

The present invention is a new and improved cement panel 10 that is reinforced with a nucleated polypropylene monofilament fabric 20. As shown if FIG. 1, cement panel includes a core layer 14 that is made of a concrete composition. Core layer 14 is covered by a top layer 16 and a bottom layer 18 of reinforcement fabric 20. Preferably, top layer 16 and bottom layer 18 of fabric 20 overlap on the edge region of the cement panel 10. Because of its cementitious nature, a cement board or panel may have a tendency to be relatively brittle at its edges, which often serve as points of attachment for the boards. Accordingly, by overlaying the fabric 20 at these regions the strength of the cement board edges is augmented and the boards retain sufficient structural integrity such that they remain attached.

Figure 2:
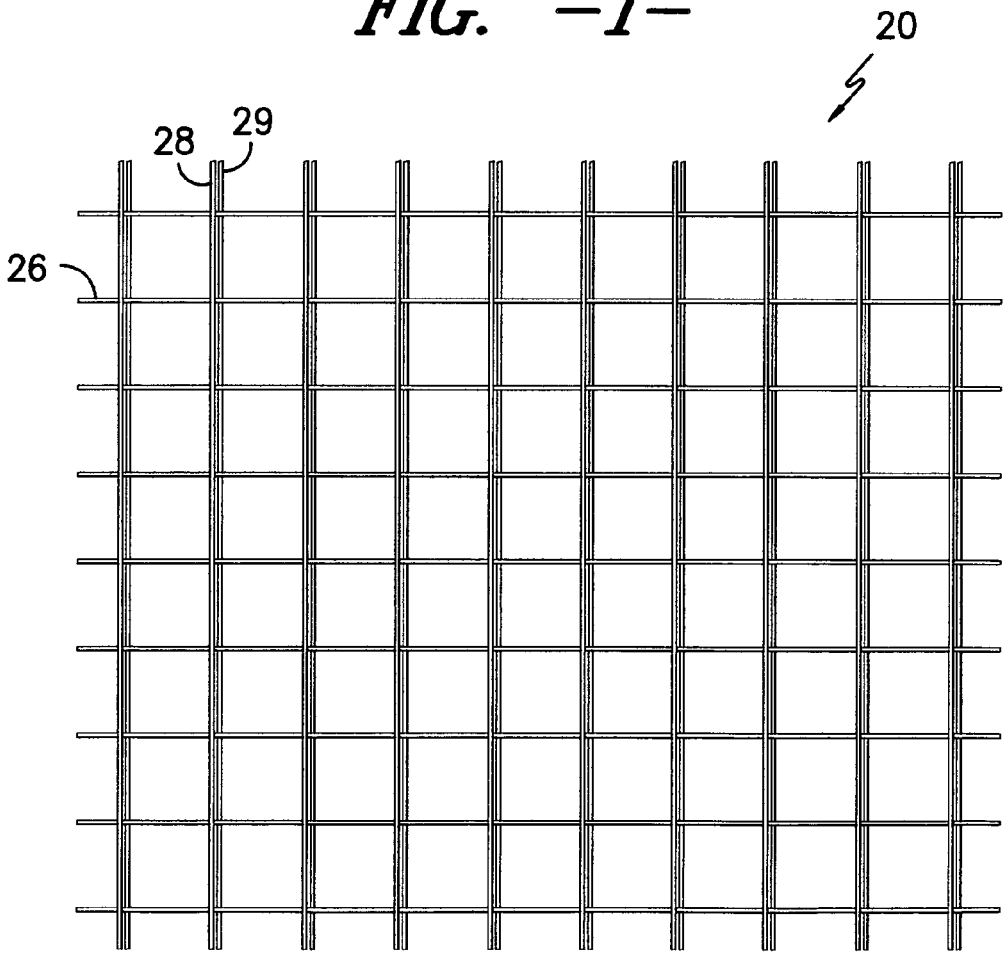
FIG. 2 is a top view of a reinforcement fabric for use in combination with cement panels according to a preferred embodiment of the present invention.

In FIG. 2, there is shown in detail reinforcement fabric 20 according to a first embodiment of the present invention. As illustrated, reinforcement fabric 20 is a bi-directional scrim, and includes a layer of parallel weft yarns 26 that are disposed between two convergent layers of parallel warp yarns 28, 29. Optionally, these yarns may be held together by an adhesive, such as polyvinyl alcohol (PVOH), acrylic, polyvinyl acetate, polyvinyl chloride, polyvinylidiene chloride, polyacrylate, acrylic latex or styrene butadiene rubber (SBR), plastisol, or any other suitable adhesive. This adhesive coating may be dried upon application so as to stabilize reinforcement fabric 20.

In the preferred fabric construction, warp yarns 28, 29 are disposed at approximately 4 to 25 ends per inch, and the weft yarns 26 are disposed at approximately 4 to 25 ends per inch. A more preferred fabric construction is 10 to 20 ends per inch in the warp and weft directions, and a most preferred construction is 10 to 15 ends per inch. Further, warp yarns 28, 29 and weft yarns 26 are preferred in the denier range of 150 to 2000, more preferred in the denier range of 500 to 1000, and most preferred in the 500 to 800 denier range. It is contemplated that the denier of warp yarn 28, 29 and/or weft yarn 26, as well as the number of warp yarns 28, 29 and/or weft yarns 26 per inch can be increased or decreased, as preferred in meeting the strength and modulus requirement of the finished cement panel 10.

As previously discussed, the use of nucleated polypropylene fibers to make reinforcement fabric 10 is a particular feature of the present invention. Preferably, both warp yarns 28, 29 and weft yarns 26 are made of nucleated polypropylene fibers. The use of nucleated polypropylene fibers minimizes or eliminates the need for a protective coating over reinforcement fabric 20. Further, nucleated polypropylene includes the same if not more beneficial features of other typically used cement reinforcement materials including high strength, high modulus of elasticity, and lightweight. Finally, nucleated polypropylene has improved high temperature shrinkage characteristics as compared to non-nudeated polypropylene, and exhibits a lesser degree of degradation during the curing phase of the cement panels. Therefore, less nucleated polypropylene fiber needs to be employed in the reinforcement of the panels.

Alternatively, only warp yarns 28, 29 or weft yarns 26 of reinforcement fabric 20 are made of nucleated polypropylene fibers and the corresponding weft yarns 26 or warp yarns 28, 29 are made of fibers such as polyester, polyamides, polyolefin, ceramic, nylon, fiberglass, basalt carbon, and aramid. In another alternative embodiment, the yarns in both the warp and weft direction could include alternating yarns made of nucleated polypropylene fiber and a second fiber such as those listed above. As used herein, the term "alternating" includes any combination of nucleated polypropylene fibers with a second fiber, including both multiple nucleated polypropylene fibers next to multiple second fibers, as well as a single nucleated polypropylene fiber next to a single second fiber.

Figure 3:
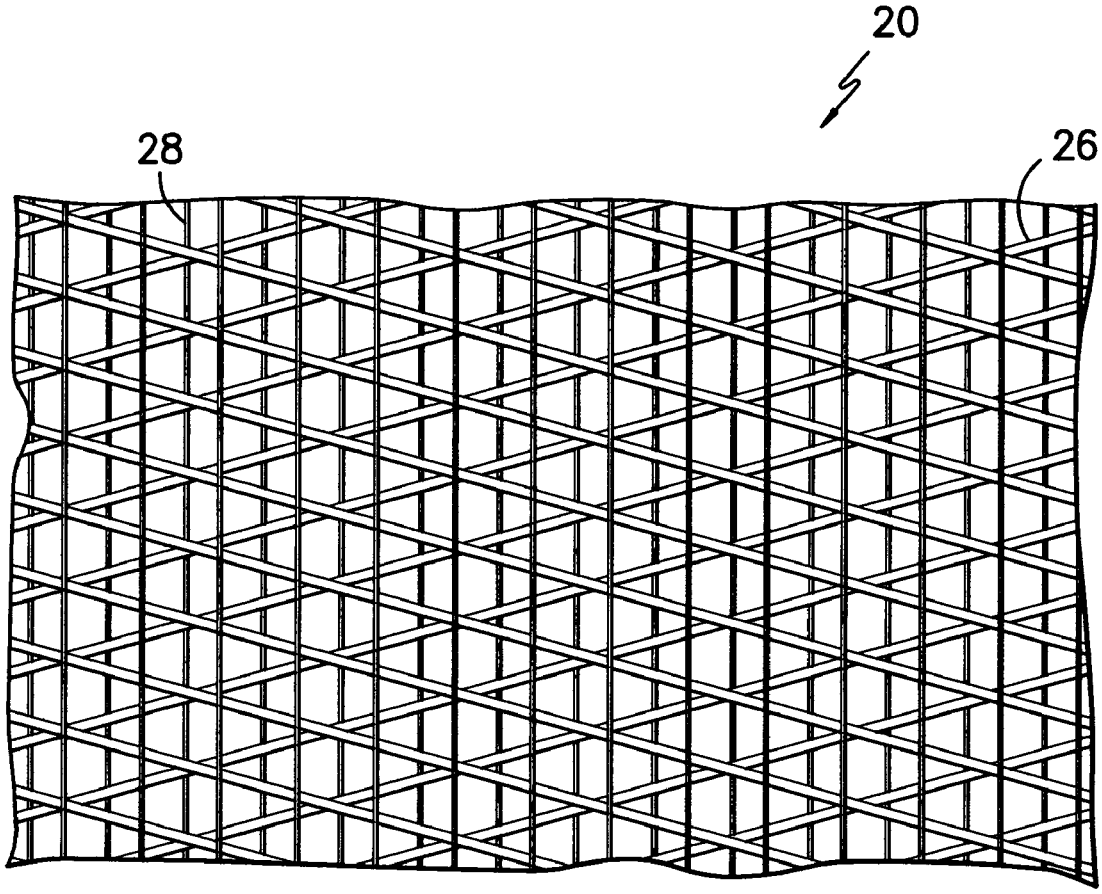
FIG. 3 is a top view of a reinforcement fabric for use in combination with cement panels according to an alternative embodiment of the present invention.

FIG. 3 illustrates reinforcement fabric 20 according to a second embodiment. As shown, reinforcement fabric 20 is a tri-directional, or triaxial scrim fabric that may optionally be woven or may be held together by an adhesive composition, such as polyvinyl alcohol (PVOH), acrylic, polyvinyl acetate, polyvinyl chloride, polyvinylidiene chloride, polyacrylate, acrylic latex or styrenebutadiene rubber (SBR), plastisol, or any other suitable adhesive. In a triaxial construction, plural weft yarns 26 having both an upward diagonal slope and a downward diagonal slope are located between plural longitudinal warp yarns 28 that are located on top of the weft yarns 26 and below the weft yarns 26. The preferred range of the fabric construction of reinforcement fabric 20 is between approximately 4×2×2 (4 ends/inch in the warp direction, and 2 ends per inch on the upward diagonal slope in the weft direction, and 2 ends/inch on the downward diagonal slope in the weft direction) and 18×9×9, and is most preferably 8×3×3. Further, warp yarns 28 and weft yarns 26 are preferred in a denier range of 150 to 2000, more preferred in the range of 500 to 1000 denier, and most preferred in the range of 500 to 800 denier.

Similar to the first embodiment, this adhesive coating of reinforcement fabric 20 is dried upon application so as to stabilize reinforcement fabric 20. Preferably, both warp yarns 28 and weft yarns 26 are made of nucleated polypropylene fibers. Alternatively, only warp yarns 28 or weft yarns 26 of reinforcement fabric 20 are made of nucleated polypropylene fibers and the corresponding weft yarns 26 or warp yarns 28 are made of fibers such as polyester, polyamides, polyolefin, ceramic, nylon, fiberglass, basalt carbon, and aramid. In another alternative embodiment, the yarns in both the warp and weft direction could be made of could include yarns made of materials such as those listed between each nucleated polypropylene yarn.

Yarns

The preferred yarns are unique thermoplastic (polypropylene, specifically) monofilament yarns that exhibit heretofore unattained physical properties, as set forth in U.S. patent application Ser. Nos. 10/443,003, 10/295,463, and 10/449,423. All patents and applications mentioned herein are hereby incorporated herein by reference in their entirety. Such fibers are basically manufactured through the extrusion of thermoplastic resins that include a certain class of nucleating agent therein, and are able to be drawn at high ratios with such nucleating agents present, that the tenacity and modulus strength are much higher than other previously produced thermoplastic fibers (particularly those produced under commercial conditions), particularly those that also simultaneously exhibit extremely low shrinkage rates. Generally, these compounds include any structure that nucleates polymer crystals within the target thermoplastic after exposure to sufficient heat to melt the initial pelletized polymer and allowing such an oriented polymer to cool. The compounds must give rise to polymer crystallization at a higher temperature than the target thermoplastic without the nucleating agent during cooling. In such a manner, the "rigidifying" nucleator compounds provide nucleation sites for thermoplastic crystal growth. The preferred compounds include dibenzylidene sorbitol based compounds, as well as less preferred compounds, such as [2.2.1]heptane-bicyclodicarboxylic acid, otherwise known as HPN-68, sodium benzoate, talc, certain sodium and lithium phosphate salts (such as sodium 2,2'-methylene-bis-(4,6-di-tert-butylphenyl)phosphate, otherwise known as NA-11, and NA21).

One preferred embodiment of the yarn includes a monofilament thermoplastic fiber comprising at least one nucleator compound, wherein said fiber exhibits a shrinkage rate of at most 10% at 135° C. and a 3% secant modulus of at least 100 gf/denier, and optionally a tenacity measurement of at least 5 gf/denier. Also envisioned is a polypropylene monofilament fiber meeting these specific physical characteristic requirements. Such fibers can have any cross section; two common cross sections will be a round cross section, or a highly elongated rectangular cross section such as that produced when making slit film monofilaments (tape).

A method of producing such fibers comprises the sequential steps of a) extruding a heated formulation of thermoplastic resin comprising at least one nudeator compound into a fiber; b) immediately quenching the fiber of step "a" to a temperature which produces a solid fiber with minimal orientation; c) mechanically drawing said individual fibers at a draw ratio of at least 5:1 while exposing said fibers to a temperature of at between 250 and 450° F., preferably between 300 and 450° F., and most preferably between 340 and 450° F., thereby permitting crystal orientation of the polypropylene therein; and d.) an optional heat setting step. Preferably, step "b" will be performed at a temperature of at most 95° C. and at least about 5° C., preferably between 5 and 60° C., and most preferably between 10 and 40° C. (or as close to room temperature as possible for a liquid through simply allowing the bath to acclimate itself to an environment at a temperature of about 25–30° C.). The quench is facilitated by using a liquid with a high heat capacity such as water. Again, such a temperature is needed to ensure that the component polymer (being polyolefin, such as polypropylene or polyethylene, polyester, such as polyethylene terephthalate, or polyamide, such as nylon 6, and the like, as structural enhancement additives therein that do not appreciably affect the shrinkage characteristics thereof) does not exhibit significant orientation of crystals. Upon the heated draw step, such orientation is effectuated which has now been determined to provide the necessary strength and modulus of the target fibers. Generally, high draw ratios facilitate breakage of the fibers during manufacture, therefore, leading to greater costs and much longer manufacturing times (if possible). However, with such high draw ratios, greater tensile strength, and modulus strengths are available as well. The addition of at least one nucleator compound to the thermoplastic resin, which is submitted to high draw ratio, allows for the production of an ultra high modulus monofilament fiber with significantly less shrinkage than a fiber generated under similar conditions without the nucleator compound. Thus, as a continuous process, this method provides surprisingly good results in physical characteristics by permitting high draw ratios to be utilized without breakage of the fibers during production. Hence, to effectuate such desirable physical characteristics, the drawing speed to line speed ratio should exceed at least 5, preferably at least 10, and more preferably, at least 12, and most preferably at least 14 times that of the rate of movement of the fiber through the production line after extrusion. Preferably, such a drawing speed is at from 400–2000 feet/minute, while the prior speed of the fibers from about 25–400 feet/minute, with the drawing speed ratio between the two areas being from about 5:1 to about 20:1, and is discussed in greater detail below, as is the preferred method itself. The optional step "d" final heat-setting temperature "locks" the polypropylene crystalline structure in place after extruding and drawing. Such a heat-setting step generally lasts for a portion of a second, up to potentially a couple of minutes (i.e., from about $1/10^{th}$ of a second, preferably about ½ of a second, up to about 3 minutes, preferably greater than ½ of a second). The heat-setting temperature should be in excess of the drawing temperature and must be at least 265° F., more preferably at least about 300° F., and most preferably at least about 350° F. (and as high as 450° F.).

The term "mechanically drawing" or "mechanically drawn", or the like, is intended to encompass any number of procedures that basically involve placing an extensional force on fibers in order to elongate the polymer therein. Such a procedure may be accomplished with any number of apparatus, including, without limitation, godet rolls, nip rolls, steam cans, hot or cold gaseous jets (air or steam), and other like mechanical means.

Such yarns may also be produced through extruding individual fibers of high thickness and of a sufficient gauge, thereby followed by drawing and heatsetting steps in order to attain such low shrinkage rate properties. All shrinkage values discussed as they pertain to the inventive fibers and methods of making thereof correspond to exposure times for each test (hot air and boiling water) of about 5 minutes. The heat-shrinkage at about 135° C. in hot air is, as noted above, at most 10% for the inventive fiber; preferably, this heat-shrinkage is at most 7%; more preferably at most 5%; and most preferably at most 2%. Also, the amount of nucleating agent present within the inventive monofilament fiber is from about 50 to about 5,000 ppm; preferably this amount is at least 500 ppm; and most preferably is at least 1000 ppm, up to a preferred maximum (for tensile strength retention) of about 5000 ppm, more preferably up to 4000 ppm, and most preferably as high as 3000 ppm. Any amount within this range should suffice to provide the high draw ratios, and the desired shrinkage rates after heat-setting of the fiber itself.

The term "polypropylene" is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as syndiotactic, isotactic, and the like). Thus, the term as applied to fibers is intended to encompass actual long strands, tapes, threads, and the like, of drawn polymer. The polypropylene may be of any standard melt flow (by testing); however, standard fiber grade polypropylene resins possess ranges of Melt Flow Indices between about 2 and 50. A preferred range is about 2 to about 35, a more preferred range is between about 2 and about 12, and a most preferred range is between about 2 and about 6. Contrary to standard plaques, containers, sheets, and the like (such as taught within U.S. Pat. No. 4,016,118 to Hamada et al., for example), fibers clearly differ in structure since they must exhibit a length that far exceeds its cross-sectional dimension area (such, for example, its diameter for round fibers). Fibers are extruded and drawn; articles are blow-molded or injection molded, to name two alternative production methods. Also, the crystalline morphology of polypropylene within fibers is different than that of standard articles, plaques, sheets, and the like. Polypropylene articles generally exhibit spherulitic crystals while fibers exhibit elongated, extended crystal structures (i.e., shish-kabobs). Thus, there is a great difference in structure between fibers and polypropylene articles such that any predictions made based on spherulitic particles (crystals) of nucleated polypropylene do not provide any basis for determining the effectiveness of such nucleators as additives within polypropylene fibers.

The terms "nucleators", "nucleator compound(s)", "nucleating agent", and "nucleating agents" are intended to generally encompass, singularly or in combination, any additive to polypropylene that produces nucleation sites for polypropylene crystals from transition from its molten state to a solid, cooled structure. Hence, since the polypropylene composition (including nucleator compounds) must be molten to eventually extrude the fiber itself, the nucleator compound will provide such nucleation sites upon cooling of the polypropylene from its molten state. The only way in which such compounds provide the necessary nucleation sites is if such sites form prior to polypropylene recrystallization itself. Thus, any compound that exhibits such a beneficial effect and property is included within this definition. Such nucleator compounds more specifically include, as advanced nucleator types, dibenzylidene sorbitol types, including, without limitation, dibenzylidene sorbitol (DBS), monomethyldibenzylidene sorbitol, such as 1,3:2,4-bis(p-methylbenzylidene) sorbitol (p-MDBS), dimethyl dibenzylidene sorbitol, such as 1,3:2,4-bis(3,4-dimethylbenzylidene) sorbitol (3,4-DMDBS), and HPN-68. Other nucleators, but also preferred in certain circumstances, include without limitation, NA-11, NA-21, sodium benzoate (and like salts), talc, and the like. The concentration of such nucleating agents (in total) within the target polypropylene fiber is at least 200 ppm up to 5000 ppm, preferably at least 1500 ppm to 4000 ppm, and most preferably from 2000 to 3000 ppm.

Also, without being limited by any specific scientific theory, it appears that the nucleators that perform the best are those which exhibit relatively high solubility within the propylene itself. Thus, compounds which are readily soluble, such as 1,3:2,4-bis(p-methylbenzylidene) sorbitol provides the lowest shrinkage rate for the desired polypropylene fibers. The DBS derivative compounds are considered the best shrink-reducing nucleators within this invention due to the low crystalline sizes produced by such compounds. Other nucleators, such as NA-11, NA-21 and HPN-68 (disodium [2.2.1]heptane bicyclodicarboxylate), also provide acceptable characteristics to the target polypropylene fiber and thus are considered as potential nucleator compound additives within this invention. Basically, the selection criteria required of such nucleator compounds are particle sizes (the lower the better for ease in handling, mixing, and incorporation with the target resin), particle dispersability within the target resin (to provide the most effective nucleation properties), and nucleating temperature (e.g., crystallization temperature, determined for resin samples through differential scanning calorimetry analysis of molten nucleated resins), the higher such a temperature, the better.

It has been determined that the nucleator compounds that exhibit good solubility in the target molten polypropylene resins (and thus are liquid in nature during that stage in the fiber-production process) provide effective low-shrink characteristics. Thus, low substituted DBS compounds (including DBS, p-MDBS, DMDBS) appear to provide fewer manufacturing issues as well as lower shrink properties within the finished polypropylene fibers themselves. Although p-MDBS and DMDBS are preferred, however, any of the above-mentioned nucleators may be utilized within this invention as long as the low shrink requirements are achieved through utilization of such compounds. Mixtures of such nucleators may also be used during processing in order to provide such low-shrink properties as well as possible organoleptic improvements, facilitation of processing, or cost.

In addition to those compounds noted above, sodium benzoate and NA-11 are well known as nucleating agents for standard polypropylene compositions (such as the aforementioned plaques, containers, films, sheets, and the like) and exhibit excellent recrystallization temperatures and very quick injection molding cycle times for those purposes. The dibenzylidene sorbitol types exhibit the same types of properties as well as excellent clarity within such standard polypropylene forms (plaques, sheets, etc.). For the purposes of this invention, it has been found that the dibenzylidene sorbitol types are preferred as nucleator compounds within the target polypropylene fibers.

Fiber and Yarn Production

The following non-limiting examples are indicative of the preferred embodiment of this invention:

Yarn Production

EXAMPLE #1

Monofilament

Nucleator concentrate (DMDBS) was made by mixing powdered nucleator with powdered PP resin with an MFI of 35 (Basell PDC1302) in a high speed mixer at a 10% concentration, extruded through a twin screw extruder at an extruder temperature of 240° C., and cut into concentrate pellets. The concentrates were let down into two PP resins: the first with an MFI of 12–18 g/10 min (Exxon 1154) and the second with an MFI of 4 g/10 min (Exxon 2252) at a level of 2.25% to give 0.225% (2250 ppm) nucleator concentration in the final polymer. This mixture, consisting of PP resin and the additive nucleator, was extruded using a single screw extruder through monofilament spinnerets with 60 holes. The PP melt throughput was adjusted to give a final monofilament denier of approximately 520 g/9000 m. The molten strands of filament were quenched in room temperature water (about 25° C.), and then transferred by rollers to a battery of air knives, which dried the filaments. The filaments, having been dried, were run across the first of four sets of large rolls, all rotating at a speed of between 49 and 126 ft/min (dependent on draw ratio), before entering an oven approximately 14 ft long set to a temperature of 360° F. After leaving the first oven, the filaments were transferred to the second set of large rollers running at a speed of 524 ft/min (dependent on draw ratio) and then into second oven, set at a temperature of 360° F. The final two sets of rolls were both set at 630 ft/min and the oven between them was set at a temperature of 300° F. The individual monofilament fibers were then traversed to winders where they were individually wound. These final fibers are thus referred to as the PP monofilaments.

Several monofilament fibers were made in this manner, adjusting the PP resin and the draw ratio (rotational speed ratio between the $1^{st}$ and $3^{nd}$ set of rolls). These monofilament fibers were tested for tensile properties using an MTS Sintech 10/G instrument. They were also tested for shrinkage in an FST 3000 shrinkage tester available from Lawson-Hemphill with the heater plates set to 135° C. and a suspended weight of 8 g. Shrinkage was calculated as the average shrinkage of five samples compared in relation to the initial lengths before heat exposure. The nucleator concentration of the monofilament fiber was also measured by gas chromatography. All of these results are reported in the tables below for different fibers (with the denier measured in g/9000 m).

TABLE #1

Processing conditions of Specific Monofilament Fiber Physical Characteristics

| Sample | Resin | Nucleator | Level (ppm) | Draw Ratio |
|---|---|---|---|---|
| 1 | 1154 | N/A | 0 | 6:1 |
| 2 | 1154 | N/A | 0 | 7:1 |
| 3 | 1154 | N/A | 0 | 8:1 |
| 4 | 1154 | N/A | 0 | 9:1 |
| 5 | 1154 | N/A | 0 | 10:1 |

TABLE #1-continued

| Processing conditions of Specific Monofilament Fiber Physical Characteristics | | | | |
|---|---|---|---|---|
| Sample | Resin | Nucleator | Level (ppm) | Draw Ratio |
| 6 | 1154 | N/A | 0 | 11:1 |
| 7 | 1154 | N/A | 0 | 12:1 |
| 8 | 1154 | N/A | 0 | 13:1 |
| 9 | 1154 | DMDBS | 2250 | 11:1 |
| 10 | 1154 | DMDBS | 2250 | 12:1 |
| 11 | 1154 | DMDBS | 2250 | 13:1 |
| 12 | 1154 | DMDBS | 2250 | 14:1 |
| 13 | 2252 | N/A | 0 | 5:1 |
| 14 | 2252 | N/A | 0 | 6:1 |
| 15 | 2252 | N/A | 0 | 7:1 |
| 16 | 2252 | N/A | 0 | 8:1 |
| 17 | 2252 | DMDBS | 2250 | 8:1 |
| 18 | 2252 | DMDBS | 2250 | 9:1 |
| 19 | 2252 | DMDBS | 2250 | 10:1 |
| 20 | 2252 | DMDBS | 2250 | 11:1 |
| 21 | 2252 | DMDBS | 2250 | 12:1 |
| 22 | 2252 | DMDBS | 2250 | 13:1 |
| 23 | 2252 | DMDBS | 2250 | 14:1 |
| 24 | 1154 | N/A | 0 | 6.5:1 |

EXAMPLE #2

Monofilament

Nucleator concentrate (DMDBS and p-MDBS) was made by mixing powder phase nucleator with powdered PP resin with an MFI of 35 (Basell PDC1302) in a high speed mixer at a 10% concentration, extruded through a twin screw extruder at an extruder temperature of 240° C., and cut into concentrate pellets. The concentrates were let down into a homopolymer polypropylene resins with an MFI of 12–18 g/10 min (Exxon 1154) at a level of 2.25% to give 0.225% (2250 ppm) nucleator concentration in the final polymer. This mixture, consisting of PP resin and the additive nucleator, was extruded using a single screw extruder through monofilament spinnerets with 40 holes. The PP melt throughput was adjusted to give a final monofilament denier of approximately 520 g/9000 m. The molten strands of filament were quenched in room temperature water (about 25° C.), and then transferred by rollers to a battery of airs knives, which dried the filaments. The filaments, having been dried, were run across the first of four sets of large rolls, all rotating at a speed of between 38 and 49 ft/min (dependent on draw ratio), before entering an oven approximately 14 ft long set to a temperature of either 300 or 380° F. After leaving the first oven, the filaments were transferred to the second set of large rollers running at a speed of about 524 ft/min (dependent on draw ratio) and then into second oven, set at a temperature of 320 or 400° F. The final two sets of rolls were both set at 630 ft/min and the oven between them was set at a temperatures of either 350, 400 or 420° F. The individual monofilament fibers were then traversed to winders where they were individually wound. These final fibers are thus referred to as the PP monofilaments.

Several monofilament fibers were made in this manner, adjusting the PP resin and the draw ratio (rotational speed ratio between the $1^{st}$ and $3^{nd}$ set of rolls). These monofilament fibers were tested for tensile properties using an MTS Sintech 10/G instrument. They were also tested for shrinkage in an FST 3000 shrinkage tester available from Lawson-Hemphill with the heater plates set to 135° C. and a suspended weight of 8 g. Shrinkage was calculated as the average shrinkage of five samples compared in relation to the initial lengths before heat exposure. The nucleator concentration of the monofilament fiber was also measured by gas chromatography. All of these results are reported in the tables below for different fibers (with the denier measured in g/9000 m).

TABLE #2

| Processing conditions of Specific Monofilament Fiber | | | | | | | | |
|---|---|---|---|---|---|---|---|---|
| Sample | Resin | Nucleator | Level (ppm) | Draw Ratio | Relax Ratio(%) | Oven 1 (° F.) | Oven 2 (° F.) | Oven 3 (° F.) |
| a | 1154 | N/A | 0 | 12.9:1 | 11.1 | 300 | 320 | 350 |
| b | 1154 | N/A | 0 | 12.9:1 | 11.1 | 300 | 320 | 400 |
| c | 1154 | N/A | 0 | 15.7:1 | 11.1 | 380 | 400 | 400 |
| d | 1154 | N/A | 0 | 15.7:1 | 11.1 | 380 | 400 | 420 |
| e | 1154 | N/A | 0 | 12.9:1 | 11.1 | 300 | 320 | 350 |
| f | 1154 | DMDBS | 2250 | 12.9:1 | 11.1 | 300 | 320 | 400 |
| g | 1154 | DMDBS | 2250 | 13.4:1 | 11.1 | 380 | 400 | 420 |
| h | 1154 | DMDBS | 2250 | 12.9:1 | 11.1 | 320 | 320 | 350 |
| i | 1154 | p-MDBS | 2250 | 12.9:1 | 11.1 | 320 | 320 | 400 |
| j | 1154 | p-MDBS | 2250 | 12.9:1 | 11.1 | 300 | 320 | 350 |
| k | 1154 | p-MDBS | 2250 | 12.9:1 | 11.1 | 300 | 320 | 400 |
| l | 1154 | p-MDBS | 2250 | 12.9:1 | 1.6 | 320 | 340 | 400 |
| m | 1154 | p-MDBS | 2250 | 16.6:1 | 1.6 | 340 | 360 | 400 |

EXAMPLE #3

Monofilament Yarn

Nucleator concentrate was made by mixing Millad powder with powdered polypropylene resin with a MFI of 35 in a high speed mixer at a 10% concentration, then extruded through a twin screw extruder at an extruder temperature of 240° C., and then cut into concentrate pellets. Concentrates were made of both Millad 3988 (DMDBS) and Millad 3940 (p-MDBS). These concentrates were let down into polypropylene resin with MFI 12–18 at a level of 2.2%, to give 0.22% (2200 ppm) nucleator concentration in the final polymer concentration. This yarn was extruded through a single screw extruder at a temperature of 490° F. and extruded through a dye into a water quench bath. The quenched fibers are wrapped over four sets of draw rolls and passed through three ovens in between them in order to draw the fiber and impart the final physical properties. The temperatures and roll speeds are given in the table below.

TABLE #3

| Yarn Samples with Specific Nucleators Added | | | | | | | | | |
|---|---|---|---|---|---|---|---|---|---|
| | Nucleator | Roll Speeds (ft/min) | | | | Oven Temps. (° F.) | | | |
| Sample | Added | #1 | #2 | #3 | #4 | #1 | #2 | #3 | Draw Ratio |
| A | None | 75 | 524 | 630 | 580 | 300 | 320 | 350 | 8.4:1 |
| B | None | 86 | 519 | 628 | 557 | 300 | 320 | 350 | 7.3:1 |
| C | None | 86 | 518 | 628 | 557 | 325 | 345 | 350 | 7.3:1 |
| D | None | 75 | 524 | 630 | 558 | 325 | 345 | 350 | 8.4:1 |
| E | None | 75 | 524 | 630 | 580 | 325 | 345 | 410 | 8.4:1 |
| F | None | 86 | 520 | 630 | 557 | 325 | 345 | 410 | 7.33:1 |
| G | None | 86 | 520 | 630 | 557 | 300 | 320 | 410 | 7.33:1 |
| H | None | 75 | 524 | 630 | 557 | 300 | 320 | 410 | 8.4:1 |
| I | DMDBS | 75 | 524 | 630 | 557 | 300 | 320 | 350 | 8.4:1 |
| J | DMDBS | 86 | 520 | 630 | 557 | 300 | 320 | 350 | 7.33:1 |
| K | DMDBS | 55 | 453 | 610 | 560 | 300 | 320 | 350 | 11.1:1 |
| L | DMDBS | 86 | 520 | 630 | 557 | 325 | 345 | 350 | 7.33:1 |
| M | DMDBS | 75 | 522 | 630 | 557 | 325 | 345 | 350 | 8.4:1 |
| N | DMDBS | 75 | 522 | 630 | 557 | 325 | 345 | 410 | 8.4:1 |
| O | DMDBS | 86 | 520 | 630 | 557 | 325 | 345 | 410 | 7.33:1 |
| P | DMDBS | 86 | 520 | 630 | 557 | 300 | 320 | 410 | 7.33:1 |
| Q | DMDBS | 75 | 520 | 630 | 557 | 300 | 320 | 410 | 8.4:1 |
| R | MDBS | 75 | 525 | 630 | 557 | 300 | 320 | 350 | 8.4:1 |
| S | MDBS | 86 | 520 | 630 | 557 | 300 | 320 | 350 | 7.33:1 |
| T | MDBS | 55 | 450 | 618 | 557 | 300 | 320 | 350 | 11.2:1 |
| U | MDBS | 75 | 522 | 630 | 557 | 325 | 345 | 350 | 8.4:1 |
| V | MDBS | 86 | 524 | 630 | 557 | 325 | 345 | 350 | 7.33:1 |
| W | MDBS | 86 | 524 | 630 | 559 | 325 | 345 | 410 | 7.33:1 |
| X | MDBS | 75 | 521 | 629 | 557 | 325 | 345 | 350 | 8.39:1 |
| Y | MDBS | 75 | 524 | 630 | 559 | 300 | 320 | 410 | 8.4:1 |
| Z | MDBS | 86 | 524 | 630 | 559 | 300 | 320 | 410 | 7.33:1 |

Fiber and Yarn Physical Analyses

These sample yarns were then tested for a number of different properties, as noted below:

TABLE #4

| Processing conditions of Specific Monofilament Fiber Physical Characteristics | | | | |
|---|---|---|---|---|
| Sample | Denier g/9000 m | Tenacity (gf/den) | 3% Modulus (gf/den) | 135° C. Shrinkage (%) |
| 1 | 520 | 2.8 | 31.5 | 4.4 |
| 2 | 520 | 3.5 | 39.5 | 5.5 |
| 3 | 520 | 3.9 | 51.8 | 6.5 |
| 4 | 520 | 4.2 | 65.3 | 7.8 |
| 5 | 520 | 3.8 | 80.7 | 7.8 |
| 6 | 520 | 5.6 | 100.0 | 9.2 |
| 7 | 520 | 6.4 | 118.4 | 8.7 |
| 8 | 520 | 5.9 | 132.6 | 8.2 |
| 9 | 520 | 6.3 | 79.5 | 3.8 |
| 10 | 520 | 7.1 | 93.5 | 3.8 |
| 11 | 520 | 6.9 | 109.9 | 3.5 |
| 12 | 520 | 6.5 | 126.0 | 3.6 |
| 13 | 520 | 3.5 | 38.6 | 4.2 |
| 14 | 520 | 4.9 | 51.0 | 5.8 |
| 15 | 520 | 4.0 | 63.6 | 6.7 |
| 16 | 520 | 4.5 | 74.0 | 7.4 |
| 17 | 520 | 5.3 | 57.5 | 4.5 |
| 18 | 520 | 6.2 | 73.5 | 4.7 |
| 19 | 520 | 6.5 | 83.1 | 5.3 |
| 20 | 520 | 7.2 | 101.4 | 5.2 |
| 21 | 520 | 7.1 | 115.5 | 5.3 |
| 22 | 520 | 7.2 | 130.7 | 5.5 |
| 23 | 520 | 7.7 | 140.3 | 5.2 |
| 24 | 520 | 4.5 | 45.2 | 12.7 |

From these PP monofilament fibers, several comparative examples of each resin with and without nucleator were selected for creep testing. Creep-Strain measurements were performed as outline in Example 1. Five samples were tested for creep-strain behavior. Specifically, Samples 7, 12, 16, 22, and 24 were tested with weights of 3323 g, 3287 g, 2320 g, 3726 g and 2360 g respectively, which corresponds to 50% of the ultimate breaking strength of the sample loop. The results of these tests are reported in the table below.

TABLE #5

| Creep-Strain Results for 50% of the Ultimate Breaking Strength for Monofilament Fibers | | | | | |
|---|---|---|---|---|---|
| | % Strain | | | | |
| Time | Sample 7 | Sample 12 | Sample 16 | Sample 22 | Sample 24 |
| 0 s | 0 | 0 | 0 | 0 | 0 |
| 15 s | 4.57 | 3.59 | 5.86 | 3.77 | 8.55 |
| 30 s | 4.81 | 4.02 | 6.31 | 4.60 | 9.40 |
| 1 min | 4.81 | 4.44 | 6.53 | 5.44 | 10.04 |
| 2 mins | 5.05 | 4.65 | 6.76 | 5.44 | 10.26 |
| 5 mins | 5.29 | 4.65 | 7.21 | 5.65 | 11.54 |
| 10 mins | 5.53 | 4.86 | 7.88 | 5.86 | 13.25 |
| 20 mins | 5.77 | 5.50 | 8.11 | 6.28 | 13.68 |
| 30 mins | 6.01 | 5.71 | 8.33 | 6.49 | 14.53 |
| 1 hr | 6.25 | 5.92 | 8.78 | 7.11 | 16.45 |
| 2 hrs | 7.21 | 6.34 | 9.23 | 7.32 | 17.95 |
| 5 hrs | 7.21 | 6.77 | 9.91 | 7.74 | 20.94 |
| 8 hrs | 7.45 | 7.19 | 10.36 | 8.37 | 23.93 |
| 1 day | 7.69 | 7.40 | 11.71 | 9.00 | 30.13 |
| 2 days | 8.41 | 8.46 | 12.39 | 9.62 | 44.87 |
| 3 days | 8.89 | 9.09 | 13.06 | 10.04 | — |
| 4 days | 9.13 | 9.30 | 13.29 | 10.25 | — |
| 7 days | — | 9.51 | — | 10.88 | — |
| 8 days | — | 10.15 | — | 11.09 | — |
| 9 days | 9.86 | 10.15 | 14.41 | 11.30 | — |
| 10 days | — | 10.78 | — | 11.51 | — |
| 11 days | — | 10.99 | — | 11.51 | — |
| 14 days | — | 10.99 | — | 11.92 | — |
| 15 days | — | 11.21 | — | 11.92 | — |

Thus, the inventive monofilament fibers (12 and 22) provide excellent low creep-strain behavior with improved physical characteristics such as higher tenacities, lower shrinkage, and increased modulus. In particular, the control fibers (nonnucleated; 7, 16, and 24) exhibited times to 10% elongation of roughly 9 days (216 hours)(but at very high shrinkage levels), 8 hours (at high shrinkage), and 1 minute, whereas the inventive fibers exhibited such time to 10% elongation times of 8 days (192 hours) and 3 days (72 hours), respectively.

TABLE #6

Monofilament Fiber Physical Characteristics

| Sample | Denier g/9000 m | Tenacity (gf/den) | 3% Modulus (gf/den) | 135° C. Shrinkage (%) |
|---|---|---|---|---|
| a | 534 | 5.6 | 84.3 | 6.9 |
| b | 529 | 5.6 | 78.9 | 5.1 |
| c | 534 | 5.9 | 84.7 | 1.1 |
| d | 500 | 6.1 | 90.0 | 1.5 |
| e | 522 | 6.3 | 84.8 | 2.4 |
| f | 520 | 6.4 | 79.2 | 2.5 |
| g | 525 | 4.4 | 43.9 | 0.2 |
| h | 524 | 6.2 | 85.3 | 1.6 |
| i | 526 | 6.5 | 77.7 | 2.1 |
| j | 530 | 6.1 | 82.7 | 1.8 |
| k | 509 | 5.7 | 77.5 | 2.5 |
| l | 477 | 5.9 | 112.0 | 3.9 |
| m | 479 | 5.8 | 144.0 | 3.3 |

Thus, the inventive monofilament fibers provide excellent low creep-strain behavior with improved physical characteristics such as higher tenacities, lower shrinkage and increased modulus.

The sample yarns for Example #4 were tested for shrink characteristics at a 135° C. heat-exposure condition (hot air). The results are tabulated below, as well as for tenacity, 3% secant modulus, and denier:

TABLE #7

Experimental Physical Characteristic Measurements for Sample Yarns

| Sample | Denier | 135° Shrinkage (%) | Tenacity (gf/denier) | 3% Sec. Modulus (gf/den |
|---|---|---|---|---|
| A | 519 | 15% | 5.306 | 51.66 |
| B | 522 | 13% | 4.519 | 45.18 |
| C | 494 | 61% | 4.402 | 44.94 |
| D | 517 | 8.6% | 4.898 | 48.30 |
| E | 526 | 3.9% | 3.261 | 33.52 |
| F | 518 | 3.2% | 3.508 | 31.78 |
| G | 514 | 2.4% | 2.763 | 30.18 |
| H | 516 | 4.3% | 3.046 | 35.19 |
| I | 504 | 1.8% | 5.577 | 54.00 |
| J | 505 | 1.6% | 5.226 | 43.96 |
| K | 497 | 2.2% | 5.712 | 82.87 |
| L | 517 | 0.8% | 3.734 | 32.86 |
| M | 510 | 0.6% | 5.009 | 43.28 |
| N | 495 | 0.4% | 4.511 | 38.74 |
| O | 506 | −0.02% | 2.918 | 29.679 |
| P | 506 | 0.3% | 3.190 | 31.76 |
| Q | 513 | 0.9% | 3.413 | 36.22 |
| R | 513 | 1.7% | 5.363 | 54.15 |
| S | 506 | 1.3% | 4.673 | 46.84 |
| T | 495 | 1.6% | 5.240 | 82.41 |
| U | 516 | 0.6% | 4.842 | 43.99 |
| V | 524 | 0.8% | 3.727 | 34.13 |
| W | 508 | 0.5% | 4.038 | 36.70 |
| X | 519 | 1.2% | 4.67 | 40.53 |
| Y | 528 | 0.5% | 4.553 | 37.72 |
| Z | 502 | −0.1% | 3.011 | 30.44 |

EXAMPLE #4

Ultra-High Modulus Monofilament

An at level compounded nucleated polypropylene resin was produced by blending powdered nucleator (DMDBS) with powdered PP resin with an MFI of 4 (AtoFina 3462) in a high speed mixer at a 2500 ppm concentration, extruded through a twin screw extruder at an extruder temperature of 240° C., and cut into pellets. This nucleated pellets, consisting of PP resin and the additive nucleator, was extruded using a single screw extruder through monofilament spinnerets with 60 holes. The PP melt throughput was adjusted to give a final monofilament denier of approximately 520 g/9000 m. The molten strands of filament were quenched in room temperature water (about 25° C.), and then transferred by rollers to a battery of air knives, which dried the filaments. The filaments, having been dried, were run across the first of four sets of large rolls, all rotating at a speed of between 44 ft/min, before entering an oven approximately 14 ft long set to a temperature of 350° F. After leaving the first oven, the filaments were transferred to the second set of large rollers running at a speed of about 520 ft/min and then into second oven, set at a temperature of 395° F. The third sets of rolls were set at 590 ft/min and the third oven between them was set at a temperatures of either 395° F. The final (fourth) set of rolls was set at a speed of 630 ft/min for a total overall draw ratio of 14.3. The individual monofilament fibers were then traversed to winders where they were individually wound. These final fibers are thus referred to as the PP monofilaments.

These monofilament fibers were tested for tensile properties using an MTS Sintech 10/G instrument. They were also tested for shrinkage in an FST 3000 shrinkage tester available from Lawson-Hemphill with the heater plates set to 117° C., which give an actual temperature of 135° C. and a suspended weight of 8 g. Shrinkage was calculated as the average shrinkage of five samples compared in relation to the initial lengths before heat exposure. The nucleator concentration of the monofilament fiber was also measured by gas chromatography. All of these results are as follows (with the denier measured in g/9000 m): Tenacity-6.8 g/den, 1% Secant Modulus-190 g/den, 3% Secant Modulus-150 g/den, Elongation at Break-5.4%, Shrinkage. (135° C.)-4.7%.

After extrusion, the yarn was loaded into a roll-off warper creel. The yarn was then warped onto section beams. The section beams were re-beamed onto a loom beam using a re-beaming machine. A fabric was made in a plain weave construction on a Rigid Rapier Weave machine. The fabric construction was approximately 13 ends per inch (in the warp direction) by 15 picks per inch (in the fill direction). Tensile tests, performed as prescribed by ASTM D1682, had a Warp direction breaking force of 89 lbs, and a Filling direction breaking force of 111 lbf, with elongations of 9.5 and 8.5%, respectively.

Additionally the fabric it self was subjected to three different tests of alkali resistance. The first test exposed the fabric to a 1 N NaOH solution at room temperature for 30 minutes, the fabric was then patted dry and retested by the ATSM D1682 prescribed method. The second alkali test was similar to the first except the fabric was exposed to a 1% NaOH solution for 4 hrs, then dried and retested. The third and final test exposed the fabric to a trihydroxy solution of 3000 g distilled water, 84 g NaOH, 252 KOH, 11.1 CaOH for 24 hrs at 40° C., patted dry and the further dried in a hot air oven for 4 hrs at 80° C. Each test was performed with 5 replicates in each the warp and fill direction. The fabric subjected to each of these tests experience less than 5% strength loss (ASTM D1682) and in the vast majority no physical property loss was observed.

Thus, the inventive fibers exhibit excellent high modulus levels as well as simultaneously low shrinkage rates, characteristics that have heretofore been simultaneously unattainable for monofilament thermoplastic fibers.

Those skilled in the art of cement panels will recognize that many substitutions and modifications can be made in the foregoing preferred embodiments without departing from the spirit and scope of the present invention.

What is claimed is:

1. A reinforced cement panel, comprising:

a core layer of cementitious material; and a first layer of a reinforcement fabric disposed adjacent one side of said core layer of cementitious material, wherein said first layer includes plural weft yarns that cross plural warp yarns, and wherein at least some of said weft yarns and said warp yarns are at least partially made of nucleated polypropylene fibers.

2. The reinforced cement panel as recited in claim 1, further including a second layer of reinforcing fabric adjacent an opposed side of said core layer of cementitious material.

3. The reinforced cement panel as recited in claim 1, wherein said weft yarns and said warp yarns are made of 100% nucleated polypropylene fiber.

4. The reinforced cement panel as recited in claim 1, wherein said reinforcement fabric is bi-directional.

5. The reinforced cement panel as recited in claim 3, wherein said weft yarns and said warp yarns are disposed at 4 to 18 ends per inch.

6. The reinforced cement panel as recited in claim 1, wherein said weft yarns and said warp yarns are in a denier range from approximately 150 to 2000 denier.

7. The cement panel as recited in claim 1, wherein said reinforcement fabric is tri-directional.

8. The cement panel as recited in claim 7, wherein said reinforcement fabric has a fabric construction of 4 to 18 ends per inch in the warp direction and between 2×2 and 9×9 ends per inch in the weft direction.

9. The cement panel as recited in claim 1, wherein said weft yarns and said warp yarns are made of a combination of said nucleated polypropylene fiber and a fiber that is selected from a group consisting of polyester carbon, polyamides, polyolefin, ceramic, nylon, fiberglass, basalt, aramid, and combinations thereof.

10. The cement panel as recited in claim 1, wherein said weft yarns and said warp yarns are bonded by an adhesive.

11. The cement panel as recited in claim 10, wherein said adhesive is selected from a group consisting of polyvinyl alcohol, acrylic, polyvinyl acetate, polyvinyl chloride, polyvinylidiene chloride, polyacrylate, acrylic latex, styrene butadiene rubber, and plastisol.

12. The cement panel as recited in claim 2, wherein said first layer and said second layer of said reinforcement fabric are overlapped at the edges of said core layer.

13. The reinforced cement panel as recited in claim 1, wherein said nucleator compound is selected from the group consisting of P-MDBS, 2,4,5-TMDBS, DBS, sodium 2,2'-methylene-bis-(4,6-di-tert-butylphenyl)phosphate disodium [2.2.1]heptane bicyclodicarboxylate, and any mixtures thereof.

14. The reinforced cement panel as recited in claim 1, wherein said nucleator compound is sodium benzoate.

15. The reinforced cement panel as recited in claim 1, wherein said nucleator compound is 3,4 DMDBS.

16. A reinforced cement panel, comprising:

a core layer of cementitious material; and a first layer of a reinforcement fabric disposed adjacent one side of said core layer of cementitious material, wherein said first layer each includes plural weft yarns that cross plural warp yarns, and wherein at lease some of said plural weft yarns are made of nucleated polypropylene fibers and said plural warp yarns made of a second fiber.

17. The reinforced cement panel as recited in claim 16, further including a second layer of reinforcing fabric adjacent an opposed side of said core layer of cementitious material.

18. The reinforced cement panel as recited in claim 16, wherein said second fiber is selected from a group consisting of polyester, polyamides, polyolefin, ceramic, nylon, fiberglass, basalt carbon, aramid, and combinations thereof.

19. The reinforced cement panel as recited in claim 16, wherein said reinforcement fabric is bi-directional.

20. The reinforced cement panel as recited in claim 16, wherein said reinforcement fabric is tri-directional.

21. The reinforced cement panel as recited in claim 16, wherein said nucleator compound is selected from the group consisting of p-MDBS, 2,4,5-TMDBS, DBS, sodium 2,2'-methylene-bis-(4,6-di-tert-butylphenyl)phosphate disodium [2.2.1]heptane bicyclodicarboxylate, and any mixtures thereof.

22. The reinforced cement panel as recited in claim 16, wherein said nucleator compound is sodium benzoate.

23. The reinforced cement panel as recited in claim 16, wherein said nucleator compound is 3,4-DMDBS.

24. A reinforced cement panel, comprising:

a core layer of cementitious material;

a first layer of a reinforcement fabric disposed adjacent one side of said core layer of cementitious material, wherein said first layer each includes plural weft yarns that cross plural warp yarns, and wherein at least one of said weft yarns or said warp yarns includes alternating yarns of nucleated polypropylene fiber and a second fiber.

25. The reinforced cement panel as recited in claim 24, further including a second layer of reinforcing fabric adjacent an opposed side of said core layer of cementitious material.

26. The reinforced cement panel as recited in claim 24, wherein said second fiber is selected from a group consisting of polyester, polyamides carbon, polyolefin, ceramic, nylon, fiberglass, basalt, aramid, and combinations thereof.

27. The reinforced cement panel as recited in claim 24, wherein said reinforcement fabric is bi-directional.

28. The reinforcement cement panel as recited in claim 26, wherein said reinforcement fabric is tri-directional.

29. The reinforced cement panel as recited in claim 22, wherein said nucleator compound is selected from the group consisting of p-MDBS, 2,4,5-TMDBS, DBS, sodium 2,2'-methylene-bis-(4,6-di-tert-butylphenyl)phosphate disodium [2.2.1]heptane bicyclodicarboxylate, and any mixtures thereof.

30. The reinforced cement panel as recited in claim 22, wherein said nucleator compound is sodium benzoate.

31. The reinforced cement panel as recited in claim 22, wherein nucleator compound is 3,4-DMDBS.

* * * * *